US005911586A

United States Patent [19]

Wintergerst

[11] Patent Number: 5,911,586

[45] Date of Patent: Jun. 15, 1999

[54] SYSTEM, DEVICE AND METHOD FOR LOCKING AND UNLOCKING POWER FLOW TO AN ELECTRICAL CORD

[76] Inventor: H. Peter Wintergerst, 5 Cloverleaf Dr., Ballston Lake, N.Y. 12019

[21] Appl. No.: 08/866,420

[22] Filed: May 30, 1997

Related U.S. Application Data

[XX .
[60] Provisional application No. 60/019,574, Jun. 1, 1996.

[51] Int. Cl.[6] ..... H01R 13/44

[52] U.S. Cl. ..... 439/133; 200/43.02; 70/264

[58] Field of Search ..... 439/133, 142; 200/51 R, 43.02, 43.08, 43.22; 70/264, 57, DIG. 30

[56] References Cited

U.S. PATENT DOCUMENTS

| | | | |
|---|---|---|---|
| 2,777,023 | 1/1957 | Sepulveda | 200/43.02 |
| 3,535,899 | 10/1970 | Gardner et al. | 439/133 |
| 4,247,743 | 1/1981 | Hinton et al. | 200/44 |
| 5,070,219 | 12/1991 | Grosskrueger et al. | 200/43.08 |
| 5,071,360 | 12/1991 | Lindow et al. | 439/133 |
| 5,193,665 | 3/1993 | Jankow | 200/43.08 |

OTHER PUBLICATIONS

Packaging for Connect–A–Plug by Doskocil showing diagram of Connect–A–Plug device and instructions for use.

*Primary Examiner*—Neil Abrams
*Assistant Examiner*—Barry Standig
*Attorney, Agent, or Firm*—Jay R. Yablon

[57] ABSTRACT

This disclosure describes an electrical power cord or adapter which, by using a lock and key mechanism, will enable or disable power from flowing through said power cord or adapter. It also describes various methods for locking and unlocking a plug to and from the female receptacle of said power cord or adapter. The purpose of such a power cord or adapter is to prevent unauthorized use of any electrical device that may be plugged in to said power cord or adapter, by disabling a flow of current to that device and by locking the plug of that device to the female receptacle of said power cord or adapter. When the appropriate key is used, power flow may be resumed, or the plug may be removed.

21 Claims, 3 Drawing Sheets

SYSTEM, DEVICE AND METHOD FOR LOCKING AND UNLOCKING POWER FLOW TO AN ELECTRICAL CORD

CROSS-REFERENCE TO RELATED APPLICATIONS

This application claims the benefit of U.S. Provisional application Ser. No. 60/019,574, filed Jun. 11, 1996.

BACKGROUND OF THE INVENTION

Parents have long been concerned about the their children spending too much time in front of the television, or watching shows that the parents would rather they not watch. In many office environments, where sensitive information is stored on electronic computers, there is a clear interest in preventing access to a computer by other than authorized personnel. And generally, the interest in controlling and restricting access to any device powered by electricity may involve issues of security, propriety and control.

While various means exist to control access to televisions (e.g., V-Chip), computers (e.g., various types of security programs) and other devices, these are all generally of a "high-technology" nature, and understanding or controlling these devices is often beyond abilities of many people, who may have difficulty even with the relatively simple task of programming a VCR. Further, these means are often specific to the particular device, and do not provide a simple, low-cost, easy-to-use solution for universally controlling and restricting access to any and all devices powered by electricity in a fully generic manner.

SUMMARY OF THE INVENTION

The invention disclosed herein is a System, Device and Method for Locking and Unlocking Power Flow to an Electrical Cord. The device used to achieve this combines in a novel manner, two devices long known in the electrical and mechanical arts: a simple on-off power switch, and physical "locking and unlocking" devices, respectively.

The invention is really quite simple, and is embodied in a simple electrical device, which can be in the form of an "extension cord" type device or a simple "electrical adapter" device. This device, on one end, contains a standard "male" plug that plugs directly into a standard power outlet. On the other end, it contains a standard "female" socket, into which the "male" plug providing power to any electrical apparatus (e.g., television, computer) can be plugged in order to receive power. However, this device is further provided with a "locking and unlocking" mechanism which either disables or enables the flow of power through the device, depending upon whether said mechanism is in the "locked" or "unlocked" position, respectively. This mechanism can be a simple "lock and key," a "combination-type" lock, or even an electronic lock that requires entry of some form of password code. In any event, the person who has the "key/code" to the "locking and unlocking" mechanism can disable or enable the flow of power to an electrical apparatus, and can leave the power disabled whenever he or she wishes to ensure that nobody else will turn on the electrical apparatus without authorization.

Of course, without more, it would still be possible for someone to circumvent this System, Device and Method for Locking and Unlocking Power Flow to an Electrical Cord, by simply unplugging the subject electrical apparatus from this "extension/adapter" device, and replugging it directly into the standard power outlet. Thus, it is further necessary to establish some means (a "plug envelope") by which the male plug providing power to the electrical apparatus can be locked and secured to the female socket of this System, Device and Method, such that these two cannot be separated by someone other than the person who holds the key or code to lock or release said "envelope." Two embodiments of such a plug envelope are also contained within this disclosure.

The "lock" and "key/code" used to disable and enable power flow can be separate from the "lock" and "key/code" used to secure and release the plug envelop. However, for even greater ease of use, and to avoid the necessity of maintaining two keys/codes, it is also possible for the power enable/disable to be controlled via the same "lock" and "key/code" as is the securing and releasing of the plug envelope.

In summary, this invention therefore combines in a novel manner, a simple electrical "on-off" switch, with simple mechanical or electrical locking devices. It further provides a secure plug envelop which is shown in two embodiments, but could readily be devised by someone of ordinary skill in the mechanical arts, without undue experimentation, in many different embodiments. As a whole, this invention provides a useful, novel and nonobvious System, Device and Method for Locking and Unlocking Power Flow to an Electrical Cord.

DETAILED DESCRIPTION OF THE PREFERRED EMBODIMENT OF THE INVENTION

Figure 1:
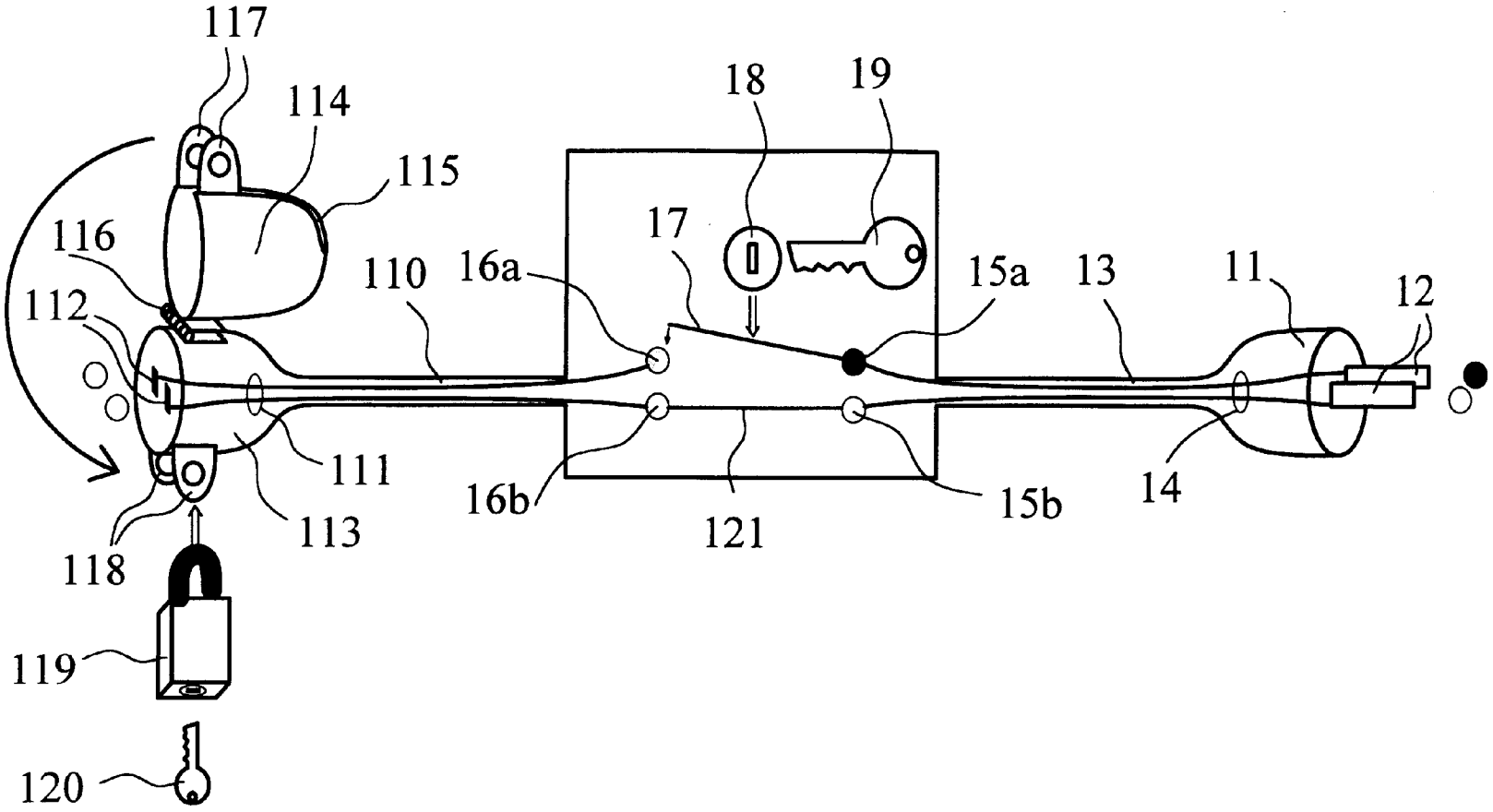
FIG. 1 depicts the key elements of the invention, embodied in an extension cord device with two distinct "lock" and "key" sets, one controlling the switch enabling/disabling power, and the other controlling the securing/releasing of the plug envelope.

FIG. 1 depicts the key elements of the invention, embodied in an extension cord device with two distinct "lock" and "key" sets, one controlling the switch enabling/disabling power, and the other controlling the securing/releasing of the plug envelope.

A standard male plug 11 is depicted comprising a pair of standard electrical prongs 12, wherein the darkened adjacent circle depict a "hot" node (often associated with a "black" wire) and the undarkened adjacent circle depicts a "cold" node (often associated with a "white" wire). For safety purposes, a standard ground prong and associated wiring can readily be introduced as well, though this is not strictly necessary for this invention and is not depicted here.

A power cord 13 houses a pair of electrical wires 14 (depicted within a vertically-oriented oval) making an electrical connection at one end to the prongs 12, and at the other end, to a pair of switch input nodes 15*a* and 15*b*. The "hot" switch input node 15*a* is depicted as darkened, and the "cold" switch input node 15*b* is depicted as undarkened.

A pair of contact nodes 16*a* and 16*b*, the former "mild" and the latter "cold," are then connected to the switch input nodes 15*a* and 15*b* as follows: The cold switch input node 15*b* has a fixed, permanent connection 121 to the cold contact node 16*b*, so that these are always at the same electrical potential. The hot switch input node 15*a*, however, is connected to the "mild" contact node 16*a* via a switch 17, said switch being an electrically-conducting lever that can be pushed through a small arc (depicted by an arc-segment arrow) to close (enable) or open (disable) the connection between the hot switch input node 15*a* and the "mild" contact node 16*a*. When this connection is closed, the mild contact 16*a* becomes "hot." When this connection is opened, the mild contact 16*a* becomes "cold."

The closing of the switch 17, is itself controlled by a "lock" 18 and "key" 19, as follows: When the key 19 is used to turn the lock 18 to a "closed" position, the lock 18 will cause the switch 17 to descend through the arc, so that it makes contact with the mild contact node 16*a* and thereby closes the connection between 15*a* and 16*a*. When the key 19 is used to turn the lock 18 to an "open" position, the lock 18 will allow the switch 17 to rise through the arc, so that it no longer contacts the mild contact 16*a*, and thereby terminates the connection between 15*a* and 16*a*.

The action of the lock 18 upon the switch 17 is schematically indicated by the downward-pointing double arrow. Using standard lock mechanisms, a person of ordinary skill in the electrical and mechanical arts, without undue experimentation, could devise many different, obvious ways to ensure that the lock 18, when turned, will open and close the switch 17 appropriately, with appropriate electrical insulation to ensure that someone inserting and turning the key is not subject to electrical shock from current flowing through the switch 17. Further, the rectangular construct in FIG. 1, enclosing the nodes 15 and 16, the switch 17, the fixed connection 121, and the lock 18 and key 19, is not necessarily a physical construct, but is rather a schematic construct meant to contain and depict the essential features of how the electrical connection is enabled and disabled.

Further, a continuing power cord 110 houses a pair of continuing electrical wires 111 (as with 14, depicted within a vertically-oriented oval) making an electrical connection at one end to the contacts 16*a* and 16*b*, and at the other end, to a pair of standard female electrical receptacles 112 housed in a standard female electrical socket 113.

Thus, when the standard male plug 11 is plugged into a standard electrical outlet, and a power cord from any electrical apparatus is plugged into the female socket 113, the ability of the electrical apparatus to receive power from the standard electrical outlet is controlled by the intermediate connections described thus far. When the lock 18 is turned to one position (closing the circuit), power is caused to flow from the electrical outlet to the electrical apparatus. When the lock 18 is turned to a second position (opening the circuit), power flow from the electrical outlet to the electrical apparatus is terminated.

While the electrical connections described thus far suffice to "lock" and "unlock" the flow of power to an electrical cord plugged in to the female electrical socket 113, they do not, by themselves, prevent someone from simply unplugging the electrical cord from the female electrical socket 113, and simply replugging the electrical cord directly into the electrical outlet. To prevent this, a locking/unlocking means is required to firmly secure the electrical cord to the female electrical socket 113, such that these cannot be disconnected without the proper key.

While a limitless number of obvious variations can be developed to secure the power cord connection to the female electrical socket 113, the embodiment depicted in FIG. 1 is as follows:

A plug envelope 114 with a cord notch 115 is securely attached to the female electrical socket 113 by a hinge 116 allowing semicircular rotation of the envelope 114 (as depicted by the semicircular arrow), such that it will envelope the plug on the electrical cord to the electrical apparatus, when said plug is plugged into the female electrical socket 113. Affixed securely to the plug envelope 114 is a pair of plug envelope locking wings 117 with holes as depicted. Affixed securely to the female electrical socket 113 is a second pair of electrical socket locking wings 118 with holes also depicted.

When the plug of the electrical cord to the electrical apparatus is plugged in to the female electrical socket 113, the plug envelope 114 may then be rotated about the hinge 116 such that the holes in the plug envelope locking wings 117 are fully aligned with the holes in the electrical socket locking wings 118. The cord notch 115 enables the envelope 114 to easily envelop the plug, wherein the cord itself fits into and protrudes through the notch 115. Thereafter, a standard padlock 119 (or combination or similar lock) can be inserted through the aligned holes of both sets of locking wings 117 and 118, and the padlock can be closed. It then becomes impossible to disconnect the plug and cord to the electrical apparatus, from the female electrical socket 113, without first using a second "key," 120, to open the padlock 119.

Again, many obvious variations can be conceived for securing the plug envelope 114 to the female socket 113 such that any male plug plugged into 113 will also remain secure. For example, rather than swivel through a half-arc around the hinge 116, one can dispense with 116 and instead provide the envelope 114 and socket 113 with threading such that they can be screwed together securely, and then locked into a position that prevents unscrewing without the key 120. In this situation, the envelope would be a fully removable component. And, again, this is simply meant to illustrate the many ways in which a person of ordinary skill in the mechanical arts might design a method for securing a male plug into the female socket 113.

Figure 2:
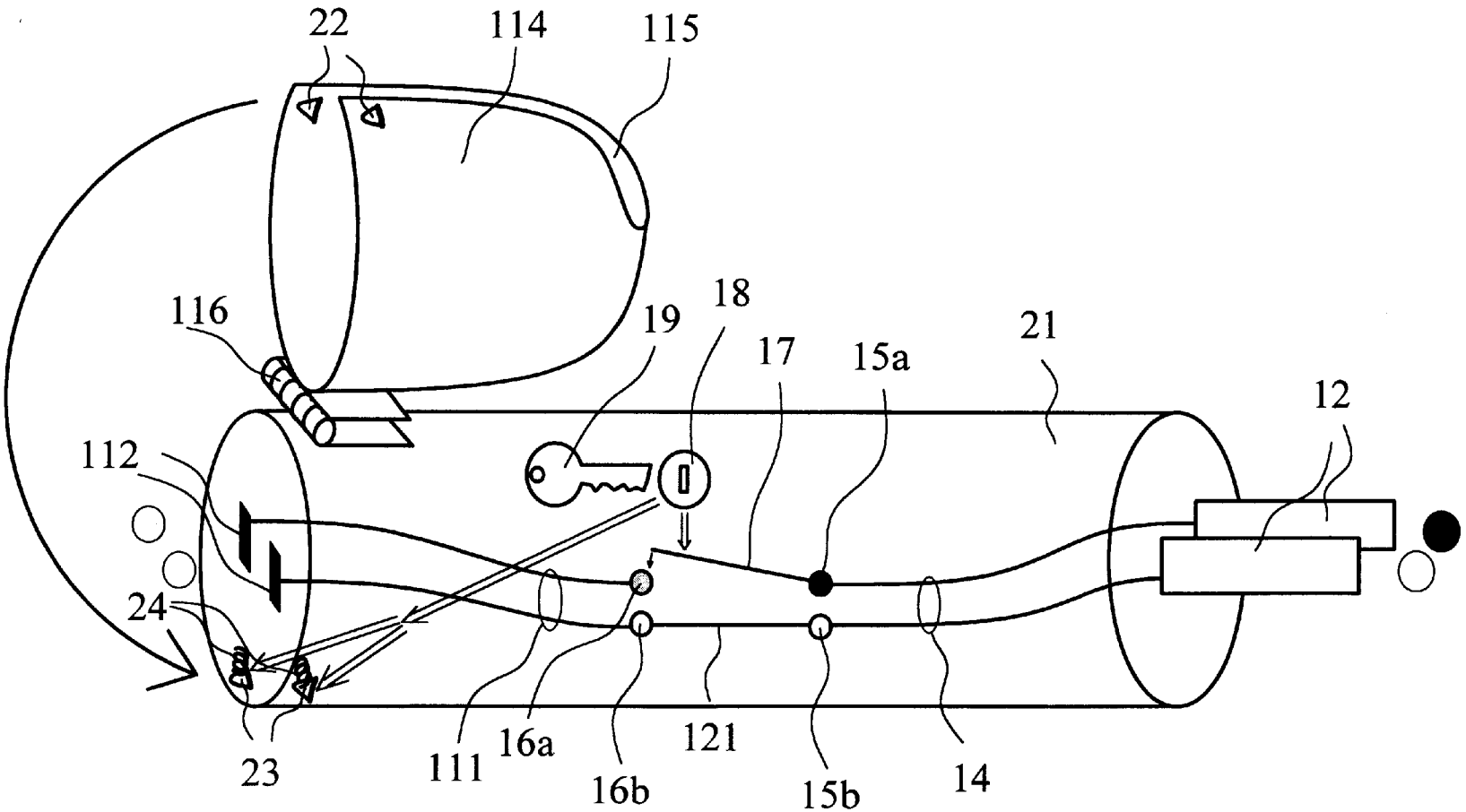
FIG. 2 depicts an alternative variation of the invention, embodied in an adapter device with a single "lock" and "key" set controlling both the switch enabling/disabling power, and the securing/releasing of the plug envelope.

FIG. 2 depicts an alternative variation of the invention, embodied in an adapter device with a single "lock" and "key" set controlling both the switch enabling/disabling power, and the securing/releasing of the plug envelope.

FIG. 2 varies from FIG. 1 primarily insofar as the plug and cord housing of FIG. 1, which encompassed 11, 13, 110, and 113, is now replaced by a simple adapter 21. This adapter, however, houses an identical set of electrical connections involving 12, 14, 15*a* and 15*b*, 17, 121, 16*a* and 16*b*, 111 and 112. The switch 17 is still moved through the depicted arc so as to open or close the contact with node 16*a*, as a result of using the key 19 to turn the lock 18.

What is significant about FIG. 2, is that the lock 18 now controls not only the opening and closing of the switch 17 (and thus of the circuit) as schematically represented by the double arrow reproduced from FIG. 1, but also, the lock 18 also controls the locking and releasing of the plug envelope 114 to the female end of the adapter 21, as schematically represented by the new double arrow pointing from the lock 18 to a pair of release bolts 23 mounted on springs 24. Also of interest here are a pair of "catches" 22 mounted on the inside surface of the plug envelope 114. The operation of this variation, which again is merely illustrative, is as follows:

The release bolts 23 are housed on the side of the adapter 21 near the female and of the adapter, i.e., near the receptacles 112, such that they will ordinarily protrude slightly from the surface of the adapter 21 due to a radially-outward force exerted on the bolts 23 by the springs 24. (The relevant "radius" for this discussion is that of the ovular face of the adapter that contains the receptacles 112.) However, when a small, radially-inward force is applied to them, or when the lock 18 is turned to the proper position, these release bolts 23 will recede into the adapter 21, compressing the springs 24, so as to be flush with the surface of the adapter 21.

Thus, to secure a plug into the receptacles 112, one would first plug said plug into the female receptacles 112. Next, one would swivel the plug envelope 114 about the hinge 116, allowing the cord connected to the plug to slide into the cord notch 115, similarly to what was described in connection with FIG. 1. As the envelope 114 becomes almost fully swiveled, the catches 22 would come into immediate proximity with the bolts 23, similarly to the juxtaposition of 117 and 118 in FIG. 1. The catches 22 would then directly contact and exert a radially-inward force on the bolts 23, causing the springs 24 to compress and the bolts 23 to recede to a level that is flush with the adapter 21. When the envelope becomes fully swiveled, the catches 22 would slide past the bolts 23, and the springs 24 would cause the bolts 23 to snap back out to their protruded position, thereby securing the catches 22 against the bolts 23 and locking the plug envelope 114 to the adapter 21 so as to prevent removal of the plug from the receptacles 112.

To unlock the plug envelope 114 from the adapter 21, one would simply use the key 19 to turn the lock 18 to a position that will cause the bolts 23 to recede into a position flush with the adapter 21 wherein the springs 24 are contracted, such that the catches 22 are then released and can be slid back past the bolts 23, allowing the plug envelop 114 to be rotated in a direction opposite the arrow on the large arc segment in FIG. 2, i.e., to be rotated back to its original position depicted in FIG. 2. At that point, the plug may be removed from the receptacle 112 of the adapter 21. This action of the lock 18 on the bolts 23 is depicted schematically by the double arrows running from 18 to 23. The detailed implementation of this can be brought about in a variety of ways that would be obvious to a person of ordinary skill in the mechanical arts (particularly pertaining to locking devices), without undue experimentation.

Figure 3A:
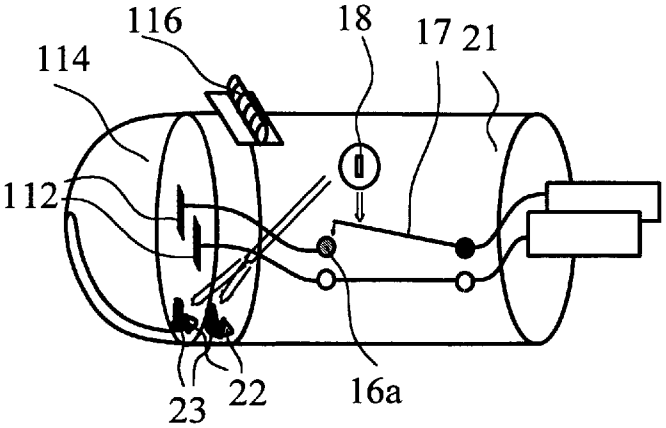
FIG. 3 schematically depicts the various lock positions used to enable and disable power, and secure and release the plug envelope.
Figure 3B:
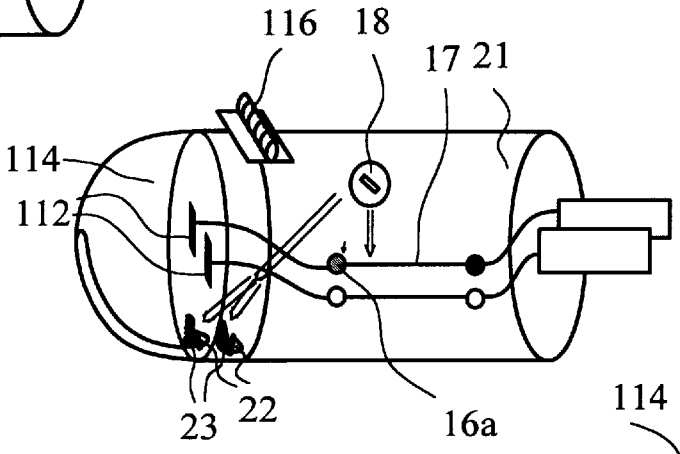
Figure 3C:
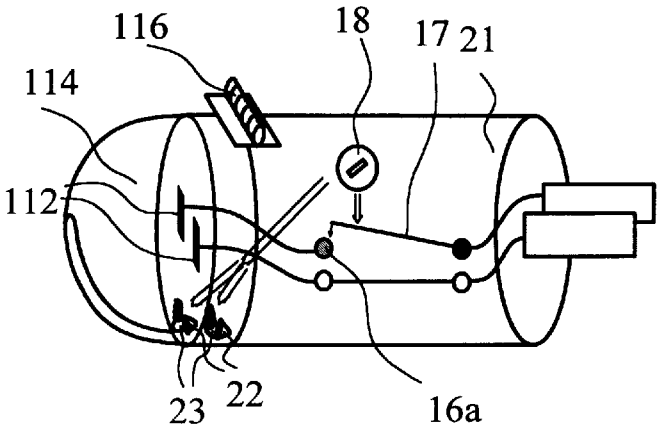

At this point, it is helpful to consider various positions and actions of the lock 18, as illustrated schematically in FIGS. 3*a*, 3*b* and 3*c*. (These figures also are helpful in depicting this device when the plug envelope 114 is closed, i.e., has been swiveled about the hinge 116, wherein the bolts 22 are securing the catches 23 so as to lock the plug envelope 114 into a locked configuration.) As depicted in FIGS. 3*a*, 3*b* and 3*c*, the lock 18 is a three-position lock, which said positions shall be referred to as positions one, two and three, corresponding respectively to FIGS. 3*a*, 3*b* and 3*c*. In position one, illustrated by FIG. 3*a*, the switch 17 is open (i.e., there is no current flow) and the bolts 23 are protruded from the surface of the adaptor 21 (represented by the darkening of the bolts 23). Thus, if the envelope 114 is swiveled about the hinge 116 so as to envelope a plug, and the catches 22 are secured against the bolts 23, the plug cannot be removed from the receptacle 112. This, in short, is the position wherein this invention prevents power from reaching an electrical device plugged into the female receptacle 112 because the switch 17 is not in contact with node 16*a*, and wherein the plug envelope 114 is locked to prevent removal of the cord and plug of said electrical device. This is illustrated in FIG. 3*a* by the keyhole in the lock 18 being depicted in a vertical orientation, the switch 17 being in a open position, and the bolts 23 being in the locked position.

When turned from position one to position two as depicted in FIG. 3*b*, the lock 18 causes the switch 17 to rotate through the small arc depicted, so as to contact 16*a* and enable a power flow through the invention to the plug and cord of the electrical device. The envelope 114 remains secure, and is unaffected by the movement from position one to position two, which is illustrated by the bolts 23 continuing to remain darkened. In short, this is the position in which this invention allows a power flow, but remains secured to the plug of the electrical device. This is illustrated in FIG. 3*b* by the keyhole in the lock 18 being depicted in a diagonal, upper-left-to-lower-right orientation, the switch 17 being in a closed position, and the bolts 23 remaining in the locked position.

Finally, when turned from position one to position three as depicted in FIG. 3*c*, the lock 18 causes the bolts 23 to recede into the adapter 21 such that the catches 22 can be released, the envelope 114 swiveled back to its original position, and the plug removed from the receptacles 112. The switch 17 remains open (no current), and is therefor unaffected by the movement from position one to position three. This is illustrated in FIG. 3*c* by the keyhole in the lock 18 being depicted in a diagonal, upper-right-to-lower-left orientation, the switch 17 being in an open position, and the bolts 23 being in the unlocked position (note that the bolts 23 are now undarkened to schematically illustrate this).

It is logically conceivable to design a fourth lock position wherein the switch 17 is closed (allowing a current flow) and the bolts 23 are retracted allowing release of the envelope 114 and removal of the plug from the receptacles 112. However, this is not necessary, and indeed, by not including such a fourth position, one adds a safety feature, since the envelope 114 is released and removal of the plug is thereby enabled only when the switch 17 is open and there is therefore no current flow.

And again, while these actions of the lock are depicted schematically in FIGS. 3*a*, 3*b* and 3*c* as discussed above, it is clear that the described locking functionality can be implemented (reduced to practice) through a variety of approaches that are well-known and obvious to someone of ordinary skill in the mechanical, locking device arts, without undue experimentation.

Finally, it is emphasized that while this disclosure discusses the locking and unlocking of the plug envelope and the power flow in terms of a mechanical (keyed and/or combination) lock and a mechanical switch, one could design the invention disclosed herein using a variety of non-mechanical or semimechanical "lock and key" and switching technologies that are well known. In particular, various electronic locks employing known electronic, semiconductor, and related technologies, as well as electromechanical technology combinations, wherein one can enter a password or similar code (key) so as to open and close the switch 17 to stop (off=digital "0") and start (on=digital "1") power flow, and release the envelope 114, are very well known, would constitute obvious variations of this disclosure, and are fully contemplated within the scope of this disclosure. Also obvious, and contemplated within this disclosure, would be the use of any form of electronic, rather than mechanical switch, to open and close the circuit. While this disclosure depicts a two-pronged, ungrounded, 120-volt standard U.S. outlet, it is obvious that a ground wire can easily be added, and that this same invention can be implemented in an obvious manner for voltages and plug configurations other than those used in the U.S. Finally, it is understood that the method of preventing power flow to an electrical cord by locking it to an adapter and terminating power flow through the adapter with a lockable switch such as is disclosed here, is also contemplated within the scope of this disclosure.

I claim:

1. A power flow locking and unlocking apparatus, comprising:

a power conduit;

power locking and unlocking means and first key means therefor for disabling a flow of power through said power conduit by causing a switch of said power conduit to open and thereby interrupt said flow of power through said power conduit when said first key means is activated to so-disable the power flow, and for reenabling said flow of power through said power conduit by causing said switch to close and thereby reinitiate said flow of power through said power conduit when said first key means is activated to so-reenable the power flow;

a lockable and unlockable plug envelope and second key means therefor for securing to and thereby preventing the removal of a plug from said power conduit by locking said plug envelope into a position enveloping said plug while said plug is plugged into said power conduit, and for releasing and thereby enabling removal of said plug from said power conduit by using said second key means to unlock said plug envelope and thereby enable said plug envelope to be moved out of said position so-enveloping said plug; whereby one is prevented from unlocking said power lock and thereby initiating said flow of power through said power conduit without access to said first key means; and one is prevented from unlocking said plug lock and thereby removing said plug from said power conduit without access to said second key means.

2. The apparatus of claim 1, said power conduit further comprising a male plug end and a female receptacle end, wherein said male plug end is inserted into a female power source to introduce said flow of power into said power conduit, and wherein said plug is inserted into said female receptacle end to receive power from said power conduit.

3. The apparatus of claim 1, wherein said power conduit comprises a power cord.

4. The apparatus of claim 1, wherein said power conduit comprises a power adapter.

5. The apparatus of claim 1, wherein said first key means and said second key means are combined to comprise a single, unitary key means, such that said unitary key means is used to so-disable and so-reenable said flow of power through said power conduit, and also to so-unlock said plug envelope.

6. The apparatus of claim 1, wherein said switch is a mechanical switch, said power locking and unlocking means comprises a mechanical lock so-opening and so-closing said switch, and said first key means comprises a mechanical key operating said mechanical lock.

7. The apparatus of claim 1, wherein said switch is an electronic switch, and said first key means comprises knowledge of an electronic key code opening and closing said electronic switch.

8. The apparatus of claim 1, wherein said switch is a mechanical switch, and said first key means comprises knowledge of an electronic key code opening and closing said mechanical switch.

9. The apparatus of claim 1, wherein said plug envelope is locked using a mechanical lock and said second key means comprises a mechanical key.

10. The apparatus of claim 1, wherein said plug envelope is locked using an electromechanical lock and said second key means comprises knowledge of an electronic key code.

11. A method for locking and unlocking the flow of power through a power conduit from a power source to a plug, comprising the steps of:

disabling said flow of power through said power conduit by causing a switch of said power conduit to open and thereby interrupt said flow of power through said power conduit when first key means is activated to so-disable the power flow;

reenabling said flow of power through said power conduit by causing said switch to close and thereby reinitiate said flow of power through said power conduit when said first key means is activated to so-reenable the power flow;

securing to and thereby preventing the removal of said plug from said power conduit by locking a plug envelope into a position enveloping said plug while said plug is plugged into said power conduit; and releasing and thereby enabling removal of said plug from said power conduit by unlocking said plug envelope and thereby enabling said plug envelope to be moved out of said position so-enveloping said plug, using second key means; whereby one is prevented from unlocking said power lock and thereby initiating said flow of power through said power conduit without access to said first key means; and one is prevented from unlocking said plug lock and thereby removing said plug from said power conduit without access to said second key means.

12. The method of claim 11, wherein said power source is a female power source, further comprising inserting a male plug end of said power conduit into said female power source to introduce said flow of power into said power conduit, and inserting said plug into a female receptacle end of said power conduit to receive power from said power conduit.

13. The method of claim 11, wherein said power conduit comprises a power cord.

14. The method of claim 11, wherein said power conduit is a power adapter.

15. The method of claim 11, comprising the further step of combining said first key means and said second key means to comprise a single, unitary key means, such that said unitary key means is used for so-disabling and so-reenabling said flow of power through said power conduit, and also for so-unlocking said plug envelope.

16. The method of claim 11, wherein said switch is a mechanical switch, and said first key means comprises a mechanical key so-opening and so-closing said switch via mechanical lock means.

17. The method of claim 11, wherein said switch is an electronic switch, and said first key means comprises knowledge of an electronic key code opening and closing said electronic switch.

18. The method of claim 11, wherein said switch is a mechanical switch, and said first key means comprises knowledge of an electronic key code opening and closing said mechanical switch.

19. The method of claim 11, wherein said steps of securing said plug to said power conduit and releasing said plug from said power conduit comprise so-locking and so-unlocking said plug envelope using a mechanical lock and said second key means means comprises a mechanical key operating said mechanical lock.

20. The method of claim 11, wherein said steps of securing said plug to said power conduit and releasing said plug from said power conduit comprise so-locking and so-unlocking said plug envelope using an electromechanical lock and said second key means comprises knowledge of an electronic key code operating said electromechanical lock.

21. A method for locking and unlocking a flow of power through a power conduit, comprising:

securing and locking a plug to said conduit by locking a plug envelope into a position enveloping said plug while said plug is plugged into said power conduit, such that said plug cannot be removed from said power conduit without access to second key means for unlocking said plug envelope and thereby enabling said plug envelope to be moved out of said position so-enveloping said plug; and disabling said flow of power through said conduit by using first key means causing a switch of said power conduit to open and thereby interrupt said flow of power through said power conduit, such that the power flow cannot be reenabled without access to said first key means for unlocking and thereby reinitiating said flow of power through said power conduit by causing said switch to close and thereby reinitiate said flow of power through said power conduit.

* * * * *